US009238994B2

(12) United States Patent
Frainet et al.

(10) Patent No.: US 9,238,994 B2
(45) Date of Patent: Jan. 19, 2016

(54) COOLING DEVICE FOR A HYBRID VEHICLE

(75) Inventors: Anthony Frainet, Montigny le Bretonneux (FR); Philippe Marcais, Courbevoie (FR); Frederic Auge, Les Lilas (FR)

(73) Assignee: Peugeot Citroen Automobiles SA (FR)

( * ) Notice: Subject to any disclaimer, the term of this patent is extended or adjusted under 35 U.S.C. 154(b) by 933 days.

(21) Appl. No.: 13/501,670

(22) PCT Filed: Sep. 21, 2010

(86) PCT No.: PCT/FR2010/051956

§ 371 (c)(1),
(2), (4) Date: Apr. 12, 2012

(87) PCT Pub. No.: WO2011/045496

PCT Pub. Date: Apr. 21, 2011

(65) Prior Publication Data

US 2012/0199313 A1 Aug. 9, 2012

(30) Foreign Application Priority Data

Oct. 13, 2009 (FR) ..... 09 57165

(51) Int. Cl.
*G05D 23/00* (2006.01)
*F01P 7/16* (2006.01)
(Continued)

(52) U.S. Cl.
CPC . *F01P 7/165* (2013.01); *F01P 3/18* (2013.01); *F28D 1/0417* (2013.01);
(Continued)

(58) Field of Classification Search
CPC .... F28D 1/0417; F28D 1/0443; F01P 11/029; F01P 3/18; F01P 7/165; F01P 2050/24; F01P 2060/08; F28F 27/02
USPC ..... 165/296, 291, 285, 283, 284
See application file for complete search history.

(56) References Cited

U.S. PATENT DOCUMENTS

2004/0194912 A1 10/2004 Honda
2005/0274507 A1 12/2005 Sanada
(Continued)

FOREIGN PATENT DOCUMENTS

DE 102005055323 A1 5/2007
EP 1059432 A2 12/2000
(Continued)

OTHER PUBLICATIONS

International Search Report corresponding to Pat. App. No. PCT/FR2010/051956, mailed Aug. 12, 2010.

*Primary Examiner* — Ljiljana Ciric
(74) *Attorney, Agent, or Firm* — Polster Lieder

(57) ABSTRACT

A device for cooling the heat engine, electrical components, and an electrical energy storage device including: a first circuit, a second circuit, and a third circuit for cooling each of the heat engine, the electrical components, and the electrical energy storage device, respectively; a heat exchange device separated into three members, including a high temperature member connected to the first circuit, a low temperature member connected to the second circuit, and a very low temperature member connected to the third circuit; an upstream valve connected between the first and the third circuit located upstream of the high temperature member of the heat exchanger in the first circuit; and, a downstream valve connected between the first circuit and the third circuit located downstream of the high temperature member of the heat exchanger in the first circuit, where the downstream valve is a thermostatic valve which is actuated as a function of the temperature of the heat transfer fluid in the first circuit and where the upstream valve is actuated as a function of flow of the heat transfer fluid in the first circuit.

9 Claims, 4 Drawing Sheets

(51) Int. Cl.

| | |
|---|---|
| ***F01P 3/18*** | (2006.01) |
| ***F28F 27/02*** | (2006.01) |
| ***F28D 1/04*** | (2006.01) |
| *F01P 11/02* | (2006.01) |

(52) U.S. Cl.
CPC ..... *F28D 1/0443* (2013.01); *F28F 27/02* (2013.01); *F01P 11/029* (2013.01); *F01P 2050/24* (2013.01); *F01P 2060/08* (2013.01); *F01P 2060/18* (2013.01)

(56) References Cited

U.S. PATENT DOCUMENTS

| | | | | |
|---|---|---|---|---|
| 2006/0254291 | A1* | 11/2006 | Allen et al. | 62/179 |
| 2009/0020080 | A1* | 1/2009 | Kowada | 123/41.08 |
| 2009/0166022 | A1* | 7/2009 | Desai et al. | 165/279 |
| 2015/0083383 | A1* | 3/2015 | Okazaki | F28F 9/26 165/173 |
| 2015/0107919 | A1* | 4/2015 | Hutchins | B60K 6/48 180/65.25 |
| 2015/0168073 | A1* | 6/2015 | Bugler, III | F24F 5/0035 165/60 |

FOREIGN PATENT DOCUMENTS

| | | | |
|---|---|---|---|
| EP | 1398200 | A1 | 3/2004 |
| EP | 1637709 | A2 | 3/2006 |
| WO | 02079621 | A1 | 10/2002 |

* cited by examiner

COOLING DEVICE FOR A HYBRID VEHICLE

CROSS-REFERENCE TO RELATED APPLICATIONS

This application is the US National stage, under 35 U.S.C. §371, of International App. No. PCT/FR2010/051956 which was filed on Sep. 21, 2010 and claims the priority of French application 0957165 filed on Oct. 13, 2009 the content of which (text, drawings and claims) is incorporated here by reference.

STATEMENT REGARDING FEDERALLY SPONSORED RESEARCH

Not Applicable.

BACKGROUND

The present invention relates to a cooling device for a hybrid vehicle, comprising an internal combustion engine coupled to an electrical machine, and a device for storing electrical energy, such as a battery. The cooling of the different electrical components, the electrical energy storage device, and the combustion engine is ensured by a heat transfer fluid circulating through thermal heat exchangers. The invention also relates to a radiator for installation in a hybrid vehicle.

For clarity purposes, the electrical energy storage device will be referred to in the specification simply by the term "battery". However, the storage device can include, for example, several batteries and/or several super capacitors. A hybrid vehicle normally uses a supplementary battery dedicated to supplying electricity to the electric motor. The storage capacity is much larger than that of the normal battery. As a result, the battery has a tendency to heat up because it is used more than in a vehicle with only a combustion engine. The battery operates optimally in a well-defined temperature range, generally about 40° C. However, cooling is necessary to maintain a temperature of about 40° C. For this purpose, cooling with air, a heat transfer fluid, or a coolant can be used. In the case of a heat transfer fluid or coolant, a cooling circuit is used having a heat exchanger, such as a radiator, for circulation of the heat transfer fluid or coolant.

Other electrical components of the vehicle also need to be cooled, such as the electrical traction motor(s) or the inverter, to operate in an optimal temperature range, generally about 60° C. Another cooling circuit having a heat exchanger is used for this purpose.

Similarly, the combustion engine needs to be cooled for operation in a typical temperature range, generally about 80° C. Another cooling circuit having a heat exchanger is used for this purpose.

In general, three cooling circuits having three heat exchangers are used with each cooling circuit operating in a different temperature range. While this configuration optimizes the cooling, it requires the addition of heat exchangers and the creation of independent cooling circuits. Therefore, it would be very advantageous to reduce the number of heat exchangers and, generally, to modify the cooling circuits for reduction of the cost and the space occupied under the hood of the vehicle.

Vehicles equipped with climate control can also use the cooling fluid of the climate control circuit. However, as discussed above, such a configuration requires a dedicated cooling circuit. In addition, this configuration generates higher energy consumption due to the operation of a climate control compressor.

FIG. 1 illustrates the most widely used prior art configuration using independent cooling circuits for circulation of a heat transfer fluid, which demonstrates the disadvantages of the prior art.

SUMMARY

According to the present invention, when the battery is cooled by a heat transfer fluid, the use of a heat exchanger is shared between the combustion engine and the battery according to the operating conditions of the vehicle. The invention takes advantage of the fact that the elements to be cooled generally do not function at the same time, and therefore do not require cooling at the same time. For example, when the combustion engine runs, the electrical traction motor is stopped, and vice versa. Therefore, one of the goals of the invention is to use only one radiator and to share as much as possible the components already present under the hood of a hybrid motor vehicle, such as a motor-ventilator group and a degassing box for filling. For this purpose, the cooling device of the present invention uses a single heat exchanger divided in three members. In addition, the present invention comprises a device for directing the flow of heat transfer fluid from one cooling circuit to another.

More specifically, the present invention relates to a device for cooling the combustion engine, the electric components, and the electrical energy storage device of a hybrid vehicle. The device includes a first circuit for cooling the combustion engine, a second circuit for cooling the electrical components, and a third circuit for cooling the electrical energy storage device, whereby a heat transfer fluid flows through the circuits which include heat exchange device. According to the invention, the heat exchange device includes a heat exchanger divided into three members: a high temperature member HT connected to the first circuit, a low temperature member BT connected to the second circuit, and a very low temperature member TBT connected to the third circuit.

In addition, the device includes a device for establishing communication between the first circuit and the third circuit, which are located upstream and downstream of the high temperature member HT of the heat exchanger. The communication device located downstream actuates as a function of the temperature of the heat transfer fluid at the location of the communication device and the communication device located upstream are actuated in function of the flow of the heat transfer fluid through the first circuit.

According to one embodiment, the communication device located between the first circuit and the third circuit and located upstream of the heat exchanger includes a double acting valve for closing the first circuit to allow the passage of heat transfer fluid from the third circuit to the high temperature member HT of the heat exchanger when the flow of heat transfer fluid in the first circuit is less than a predetermined flow. The communication device located between the first circuit and the third circuit and located downstream of the heat exchanger includes a double acting thermostatic valve for closing the first circuit to allow the passage of heat transfer fluid from the first circuit to the third circuit when the temperature of the heat transfer fluid at the location of the thermostatic valve is lower than the optimal operating temperature of the electrical energy storage device.

The first circuit includes a water pump, a water outlet box in communication with a pump, and an air heater for heating the vehicle cabin and in communication with the inlet of the high temperature member HT of the heat exchanger through the intermediary of a conduit connected between the outlet of the water outlet box and the inlet of the high temperature member HT. The conduit includes the double acting valve located at the inlet of the high temperature member HT and the outlet of the high temperature member HT connects to the pump by a pipe which includes the thermostatic valve located at the outlet of the high temperature member HT of the heat exchanger.

The third circuit includes the electrical energy storage device, a pump, and the very low temperature member TBT of the heat exchanger. The inlet of the pump connects to the outlet of the heat transfer fluid of the electrical energy storage device, and the outlet of the pump connects to the inlet of the very low temperature member TBT. The outlet of the very low temperature member TBT connects to the first circuit through the intermediary of the thermostatic valve, and or to the electrical energy storage device. The inlet of the very low temperature member TBT connects to the first circuit through the intermediary of the valve located at the inlet of the very low temperature member TBT.

The second circuit can include the low temperature member BT of the heat exchange device, a pump, an inverter, an electrical machine, and an automatic start and stop device of the combustion engine.

Advantageously, the first and third circuits include a common degassing box.

The electrical energy storage device includes at least one battery.

According to another embodiment, each of the very low temperature, high temperature, and low temperature members TBT, HT and BT includes an inlet box for the heat transfer fluid, a radiator, and an outlet box for heat transfer fluid.

The inlet boxes of very low temperature and high temperature members TBT and HT define a common passage which close with a valve so that a portion of the heat transfer fluid circulates from the very low temperature member TBT inlet box to the high temperature member HT box. The very low temperature member TBT and high temperature member HT outlet boxes define a common passage which close with a thermostatic valve so that a portion of the heat transfer fluid circulates from the high temperature member HT outlet box to the very low temperature member TBT outlet box.

When the flow of the heat transfer fluid in the first circuit for cooling of the combustion engine is less than a predetermined value, the valve opens the common passage of the inlet boxes to allow a portion of the heat transfer fluid of the very low temperature member TBT inlet box to flow to the high temperature member HT inlet box. The valve closes the first circuit when the flow of heat transfer fluid in the cooling circuit of the combustion engine is zero.

The thermostatic valve opens the common passage between the high temperature and very low temperature members HT and TBT exit boxes and closes the outlet of the high temperature member HT exit box when the temperature of the heat transfer fluid at the outlet of the very low temperature member HT is lower than a predetermined temperature. Conversely, the thermostatic valve closes the common passage between the high temperature and very low temperature members HT and TBT outlet boxes and opens the outlet of the high temperature member HT outlet box when the temperature of the heat transfer fluid at the outlet of the high temperature member HT outlet box is greater than the predetermined temperature, which equals the optimal operating temperature of the electrical energy storage device.

The first circuit for cooling the combustion engine includes a thermostatic valve located at the outlet of the water outlet box, in which the circulation of the heat transfer fluid in the first circuit stops when the temperature of the heat transfer fluid in the water outlet box is lower than the optimal operating temperature of the combustion engine.

The invention also relates to a radiator for circulation of the heat transfer fluid and installation in a hybrid vehicle. According to the invention, the radiator includes three distinct members separated from each other by a wall. Each of the members includes an inlet box having an inlet for heat transfer fluid, a heat exchanger, and an outlet box equipped with an outlet for heat transfer fluid. One of the walls separates the inlet boxes between two adjacent members to define a first passage. The wall separating the outlet boxes between the two adjacent members defines a second passage, whereby the first closing device moves between two positions. In a first position the inlet of an inlet box is open and the first passage is closed. In a second position the inlet of an inlet box is closed and the first passage is open. The second closing device moves between two positions. In a first position the outlet of an outlet box is open and the second passage is closed. In a second position the exit of the exit box is closed and the second passage is open.

The first closing device includes a double acting valve which changes position when the pressure exercised on the valve is zero. The second closing device includes a thermostatic valve which can change position at 40° C.

The foregoing and other features, and advantages of the disclosure as well as embodiments thereof will become more apparent from the reading of the following description in connection with the accompanying drawings.

DESCRIPTION OF THE DRAWINGS

In the accompanying drawings which form part of the specification:

FIG. 4 is a schematic of a radiator; and.

Corresponding reference numerals indicate corresponding parts throughout the several figures of the drawings.

DETAILED DESCRIPTION

Figure 1:
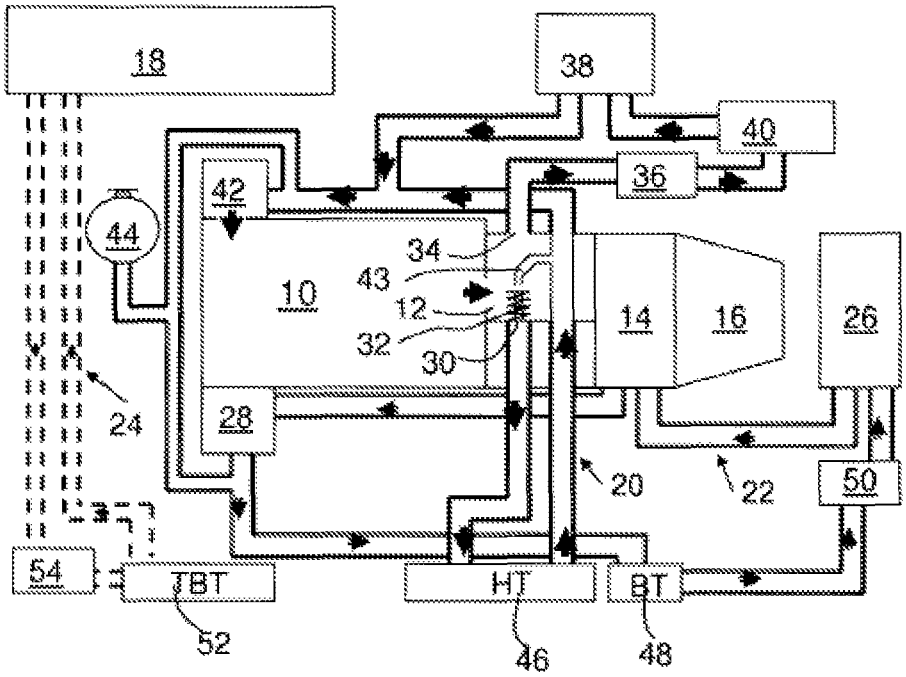
Figure 1 (Prior Art)
FIG. 1 is a schematic of a prior art cooling device.

The following detailed description illustrates the claimed invention by way of example and not by way of limitation. The description clearly enables one skilled in the art to make and use the disclosure, describes several embodiments, adaptations, variations, alternatives, and uses of the invention, including what is presently believed to be the best mode of carrying out the claimed invention. Additionally, it is to be understood that the disclosure is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

The device shown in FIG. 1 represents the most widely used configuration for cooling of the various elements of a hybrid vehicle. It includes a combustion engine 10, a water outlet box 12, an electrical machine 14 (such as the electrical motor(s) providing traction to the vehicle), a transmission 16, and electrical energy storage device 18 (such as one or more batteries or one or more super capacitors). For clarity reasons, the electrical energy storage device is referred to in the specification by the term "battery", with the understanding that this term covers all kinds of electrical energy storage device.

The hybrid vehicle includes three different cooling circuits: a first circuit 20 dedicated to cooling the combustion engine 10, (also referred to as a "HT circuit" for High Temperature and shown in FIG. 1 and the following figures in solid line); a second circuit 22 for cooling of the electrical components, (also referred to as a "BT circuit" for Low Temperature and shown in double solid line), and a third circuit 24 for cooling of the battery 18 (also referred to as a "TBT circuit" for Very Low Temperature and shown in dashed line). In general, the electrical components include the electrical machine 14, an inverter 26, and often an automatic start and stop system 28 (usually referred to as "Stop & Start"). A heat transfer fluid, usually a mixture of water and glycol such as 50% water and 50% glycol, can flow in these three circuits in directions indicated by the arrows.

In the first circuit 20 (HT circuit), the heat transfer fluid circulates in the combustion engine 10 and leaves the engine through the water outlet box 12 (remark: this is the normal designation of the outlet box, although it relates to the coolant outlet which is normally not pure water). Box 12 has two outlets: an outlet 30 which can be closed by a thermostatic valve 32 and an outlet 34. Exiting through outlet 34, the heat transfer fluid is aspirated by a pump 36, such as an electric pump, and sent to an air heater 38 to heat the vehicle cabin.

Before entering the air heater 38, the heat transfer fluid can, if necessary, pass through a reheater 40, such as an electrical or gasoline heater. Leaving the air heater 38, the fluid flows towards a pump 42, generally referred to as a "water pump", from where it returns to the combustion engine. A degassing box 44 common to the first circuit 20 and the second circuit 22 evacuates the gas which could be present in the heat transfer fluid and fills the level of heat transfer fluid in the cooling circuits 20 and 22. Exiting through the outlet 30 of the water outlet box 12, the heat transfer fluid passes through a heat exchanger 46 (HT for High Temperature), such as a radiator installed in the front of the vehicle, and passes through the water pump 42 before returning to the combustion engine 10. A bypass 43 allows for the return of the heat transfer fluid to the water outlet box 12 when the thermostatic valve 32 closes outlet 30.

The second circuit 22 (BT circuit) for cooling of the electrical components, includes a heat exchanger 48, such as a radiator (also referred to as BT exchanger or BT radiator for Low Temperature). The heat transfer fluid circulates through the second circuit 22 with an electric pump 50. The fluid then passes sequentially through the pump 50, the inverter 26, the electrical machine 14, the automatic start and stop system 28 of the combustion engine and the BT radiator 48.

The third circuit 24 (TBT circuit) includes a heat exchanger or radiator 52 or TBT (TBT for Very Low Temperature). The heat transfer fluid is circulates with an electric pump 54 and passes sequentially through the TBT radiator 52 and battery 18. In fact, the fluid does not pass through the battery 18 itself, but through the heat exchange device for cooling of the battery, such as a copper pipe in the form of a coil surrounding the battery.

The temperature HT of the heat transfer fluid present in the first HT circuit 20 can vary from 70 to 110° C. The thermostatic valve 32 closes the outlet 30 and stops the circulation of the heat transfer fluid in the first HT circuit 20 when the temperature of the fluid in the HT circuit is lower than the optimal operating temperature of the combustion engine, generally about 80° C.

The temperature of the heat transfer fluid in the second BT circuit 22 is generally maintained about 60° C., or the optimal operating temperature of the electrical machine 14.

The temperature of the heat transfer fluid in the third TBT circuit 24 is generally maintained about 40° C., or the optimal operating temperature of the battery 18.

The differences in the optimal operating temperatures of the combustion engine, the electrical machine, and the battery are the reason for using three different circuits, and thus three radiators. This increases the fabrication cost of the vehicle and increases the space occupied under the hood.

Figure 2:
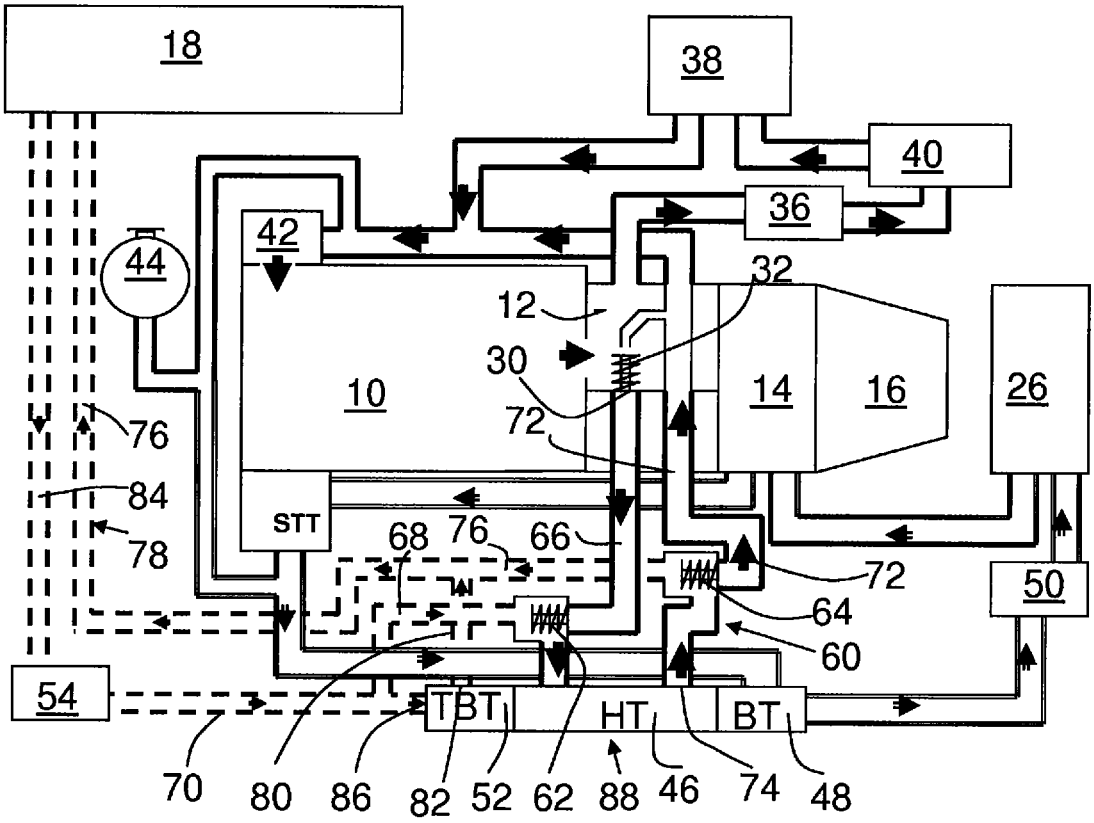
FIG. 2 is a schematic is a first embodiment of a cooling device.

FIG. 2 illustrates a schematic of a first embodiment of a cooling device or cooling system where the use of a heat exchanger is shared between the combustion engine and the battery based on the operating conditions of the vehicle. In FIG. 2, the elements common with FIG. 1 are indicated by the same reference numbers. There are three cooling circuits: the second circuit 22 (BT circuit) includes an identical radiator 48, an electric pump 50, an inverter 26, an electrical machine 14 and a Stop & Start system 28 or STT.

The first circuit 60 (HT circuit) is identical to the first circuit 20 of FIG. 1, except that the first circuit 60 of FIG. 2 includes a double acting valve 62 located upstream (in the direction of the heat transfer fluid flow) of radiator 46 (HT radiator), and a thermostatic valve 64 located downstream of the HT radiator. More specifically, valve 62 is located in a pipe 66 linking the outlet 30 of the water outlet box 12 to the HT radiator. In addition, a conduit 68 connects conduit 70, thereby, connecting the pump 54 to radiator 52 (TBT radiator). Conduit 68 communicates with pipe 66 opposite valve 62 so that when valve 62 closes pipe 66, the heat transfer fluid flows through the pipe 68 towards the HT radiator. Conversely, when valve 62 is open, the communication between pipe 66 and the HT radiator is open while the communication between pipe 68 and the HT radiator is closed.

The thermostatic valve 64 is located downstream of the HT radiator in a pipe 72 linking outlet 74 of the HT radiator with the water pump 42. The TBT circuit includes a conduit 76 linking pipe 72 with battery 18, pipe 76 connects with pipe 72 at the location of the thermostatic valve 64 so that, when valve 64 closes pipe 72, the heat transfer fluid exiting the HT radiator can flow in pipe 76 and, inversely, when valve 64 is not closing pipe 72, the heat transfer fluid exiting the HT radiator cannot flow in pipe 76.

The third circuit 78, dedicated to cooling of battery 18, includes TBT radiator 52, pipe 80 (linking the outlet 82 of radiator 52 with pipe 68), pipe 76, battery 18 (generally the electrical energy storage device), and the pump 54 connected to the battery 18 through the pipe 84 and linked to the inlet 86 of the TBT radiator 52 through the intermediary of the pipe 70.

Advantageously, radiators 52, 46 and 48 can be formed by a single heat exchanger 88 separated in three distinct members to form the three radiators, the TBT radiator 52, the HT radiator 46, and the BT radiator 48.

As before, the HT circuit 46 or first circuit is shown in continuous solid line, the BT circuit 48 or second circuit is shown in double line, and the TBT circuit 52 or third circuit in dashed line.

The double acting valve 62 establishes the communication between the first circuit 60 and the third circuit 78 when the flow of heat transfer fluid in pipe 72 is very low, or practically zero. This situation occurs when the thermostatic valve 32 closes the outlet of the water outlet box 12, which occurs when the temperature of the heat transfer fluid in the water outlet box 12 is below the optimal operating temperature of the combustion engine. The optimal operating temperature can be for example between 80 and 110° C. In this case, outlet 30 is open when the temperature of the heat transfer fluid is equal to or higher than for instance 80° C. and the output 30 is closed when the temperature of the heat transfer fluid is lower than 80° C.

When valve 32 closes outlet 30 of the water outlet box, the valve 62 opens the communication between pipe 68 and the HT radiator, thereby, placing the third circuit 78 (TBT) in communication with the first circuit 60 (HT). The double acting thermostatic valve 64 is calibrated to open pipe 72 at a predetermined temperature, which corresponds with the optimal operating temperature of battery 18. For example, this temperature can be about 40° C.

The cooling device or system functions in different ways according to the conditions of vehicle use. For example:

First Use Conditions:

Combustion engine used little or stopped,

Reheater 49 used little or stopped,

Electrical machine 14 stopped or running,

Charging of the battery starting from the electric grid.

When the temperature of the heat transfer fluid in the HT circuit 60 is less than 80° C., the thermostatic valve 32 is closed. The heat transfer fluid coming from the combustion engine 10 is directly sent to the reheater 40 and the air heater 38 to heat the vehicle cabin. When the heat transfer fluid is not flowing through the HT radiator, the flow in pipe 66 is zero. Therefore, valve 62 is in a closed position with no pressure applied on it. The heat transfer fluid of the third circuit 78 (TBT) then passes through the HT radiator in addition to the TBT radiator. In this way, the cooling of battery 18 improves by increasing the exchange surface area of the heat transfer fluid in the heat exchanger 88. Since the temperature in the third circuit TBT does not exceed 40° C., the thermostatic valve 64 is in closed position and the heat transfer fluid exiting the HT radiator is returned to battery 18. Furthermore, the thermostatic valve 64 prevents any risk of sending heat transfer fluid with a temperature higher than 40° C. to battery 18, which would degrade its performance and/or life. The flow in the third TBT circuit 78 is provided by the electric pump 54, so that the cooling of the battery is ensured when the combustion engine is stopped.

These operating conditions correspond to the times that the battery requires the most cooling. The surface area of the heat exchanger becomes more important during this period.

Second Use Conditions:

Combustion engine 10 runs,

Reheater 40 functioning or stopped,

Electrical machine 14 stopped or little used,

Charging of the battery 18 with the power of the combustion engine.

When the combustion engine requires cooling, for temperatures of the heat transfer fluid in the first HT circuit 46 higher than 80° C., the thermostatic valve 32 opens. Under the pressure of the heat transfer fluid, valve 64 also opens and closes pipe 76. The heat transfer fluid coming from the combustion engine 10 cools in the HT radiator. Since the temperature at the outlet 74 of the HT radiator is greater than 40° C., the thermostatic valve 32 also opens so that the fluid is sent in direction of the combustion engine through pipe 72. The battery 18 then cools only by the TBT radiator, whereby valve 62 and thermostatic valve 64 closes pipes 68 and 76 to link the third TBT circuit with the HT radiator.

The second operating conditions correspond to times when the battery 18 is charging starting from the power of the combustion engine 10. Therefore, only minimum cooling of the battery 18 must be provided. Since the cooling requirement is less significant than in the first conditions, the heat exchange surface of the TBT radiator is sufficient.

Figure 3:
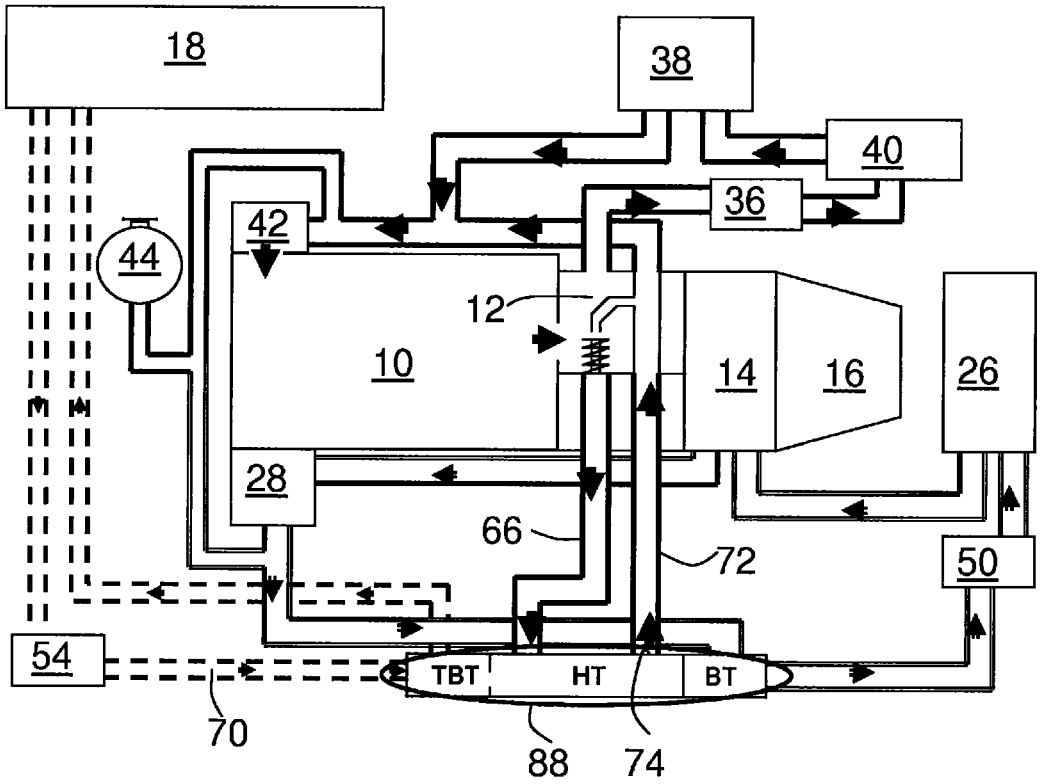
FIG. 3 is a schematic of a second embodiment of the cooling device.
Figure 4:
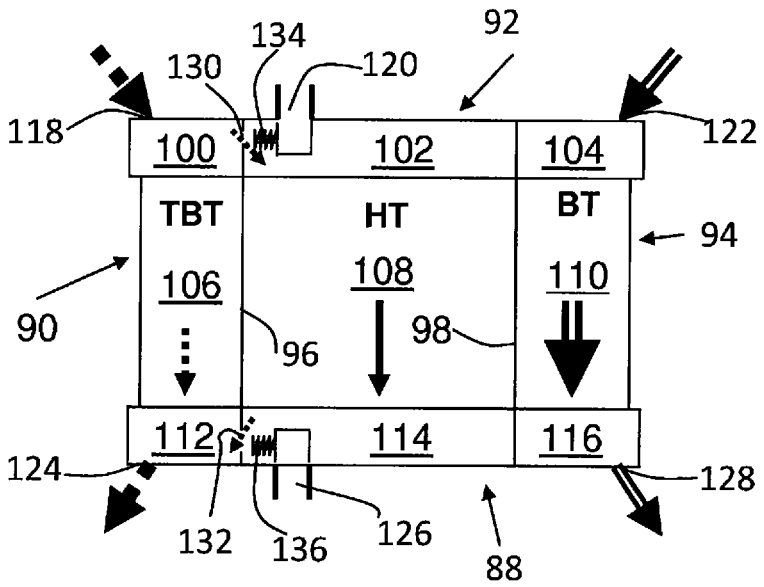
Figure 5:
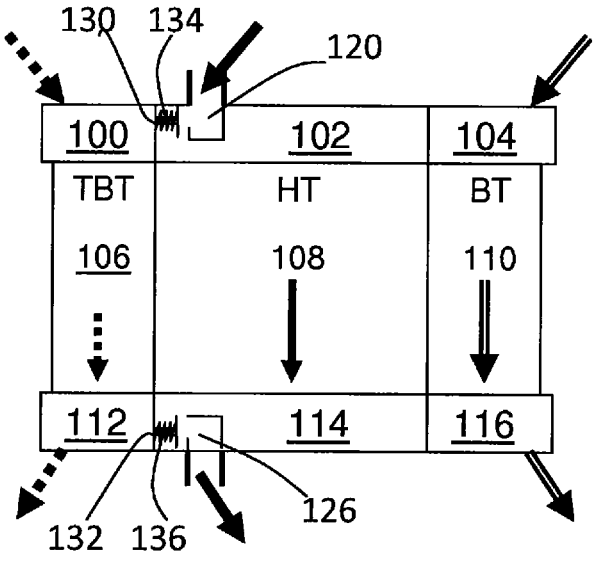
FIG. 5 is a schematic of the radiator of FIG. 4 with a water outlet box in an open position.

FIG. 3 illustrates a schematic of a second embodiment of the cooling device or system. This embodiment generally includes the same elements as those of the embodiment mode shown in FIG. 2, and the common elements are indicated by the same reference numbers. The differences between the two embodiments relate to the heat exchanger, framed in an oval 88, the valve 62, and the thermostatic valve 64. Heat exchanger 88 includes a single radiator divided in three members TBT, HT and BT. In the second embodiment, the valve 62 and the valve 64 are integrated in the HT radiator. This arrangement simplifies the HT and TBT circuits, since the communication between the HT and TBT circuits is established in the heat exchanger 88, and more specifically between the HT and TBT members of the heat exchanger, due to the use of a new type of radiator as shown in FIGS. 4 and 5. In FIG. 3, outlet 74 of the HT radiator is directly connected to water pump 42, and the communication conduit 68 and member of conduit 76 have been eliminated.

The heat exchanger 88 is represented schematically in FIG. 4, which shows a situation in which the temperature of the heat transfer fluid in the HT circuit 60 is lower than the optimal operating temperature of the combustion engine, for example, lower than 80° C. Exchanger 88 is a "complex" radiator with exchange of coolant between the TBT and HT members. This radiator includes three members: a TBT member (Very Low Temperature) 90, a HT member (High Temperature) 92, and a BT member (Low Temperature) 94. The TBT and HT members are separated by a wall 96 and the HT and BT members are separated by a wall 98.

Each of the members includes a heat transfer fluid inlet box (100 for the TBT member, 102 for the HT member and 104 for the BT member), a heat exchanger member (106 for the TBT member, 108 for the HT member and 110 for the BT member) and an outlet box (112 for the TBT member, 114 for the HT member and 116 for the BT member). The heat transfer fluid circulates in the directions indicated by the arrows in dashed lines for the TBT member 106, in solid line for the HT member 108, and double lines for the BT member 110.

Each of the inlet boxes 100, 102, and 104 is equipped with an inlet 118, 120, and 122, respectively for the heat transfer fluid. Each of the outlet boxes 112, 114 and 116 includes a fluid outlet 124, 126 and 128, respectively. Wall 96 separating the TBT and HT members 106 and 108 includes a first communication passage 130 between the inlet boxes 100 and 102 and a second communication passage 132 between outlet boxes 112 and 114. Passage 130 includes a first closing device 134 which can assume two positions, one position in which the inlet 120 of the inlet box 102 is open and the first passage 130 is closed, and a second position in which inlet 120 of the inlet box 102 is closed and the first passage 130 is open. Passage 132 includes a second closing device 136 which can assume two positions, one position in which the outlet 126 of the outlet box 114 is open and the second passage 132 is closed, and a second position in which the outlet 126 is closed the second passage 132 is open.

The closing device 134 includes a double acting valve equivalent to valve 62 of the embodiment of FIG. 2. This valve 62 closes inlet 120 and opens passage 130 when the flow in pipe 72 is very low, even zero, and therefore when the temperature of the heat transfer fluid is lower than 80° C. for example (temperature for which the thermostatic valve 32 closes the outlet 30 of the water outlet box).

The closing device 136 includes a thermostatic valve identical to the thermostatic valve 64 of the embodiment of FIG. 2. This valve closes the outlet 126 and opens passage 132 when the temperature of the heat transfer fluid in the outlet box 114 is lower than the optimal operating temperature of the battery 18, for example 40° C.

The conditions for circulation of the heat transfer fluid from the TBT circuit to the HT radiator are the following: when the thermostatic valve 32 of the water outlet box closes outlet 30, the flow in the HT radiator is zero; valve 134 closes inlet 120 of the HT radiator and the passage 130 is open; the inlet boxes 100 and 102 communicate and some of the heat transfer fluid of the TBT circuit can then pass through the HT circuit. The fluid contained in the HT radiator cools down. As soon as the temperature of this fluid is lower than 40° C., the thermostatic valve 136 opens passage 132 and closes outlet 126 of the HT radiator. The heat transfer fluid of the TBT circuit can then circulate in the HT circuit, more specifically in the radiator 108 of the HT circuit.

FIG. 5 shows the radiator of FIG. 4, when the thermostatic valve 32 of the water outlet box is in open position, in other words, when the outlet 30 is open. This corresponds with a coolant temperature higher than or equal to the optimal operating temperature of the combustion engine, for example 80° C. There is no circulation of heat transfer fluid from the TBT circuit to the HT circuit. Indeed, valve 134 closes passage 130 and opens inlet 120 of the HT radiator 108. The thermostatic valve 136 (open until about 40° C.) is open. In other words, it opens outlet 126 of the HT radiator and closes passage 132. Therefore, there is no communication between the TBT and HT circuits. In this case, the result is that the HT radiator is dedicated to the cooling of the combustion engine.

The advantages provided by the present invention are for example and in non-limiting manner:

Intelligent thermal management of the cooling circuit,

Splitting the radiator for cooling different elements operating in much different temperature ranges, The absence of a supplementary heat exchanger, either in front of the vehicle or elsewhere in the vehicle, The absence of the additional motor-ventilator group and the use of the main motor-ventilator group in front, Easier installation of the cooling circuit in the vehicle due to less space occupied by the radiator of the invention compared to the three radiators of prior art, The electrical consumption of the cooling circuit is low compared to the electrical consumption of a cooling circuit using air or coolant.

Changes can be made in the above constructions without departing from the scope of the disclosure, it is intended that all matter contained in the above description or shown in the accompanying drawings shall be interpreted as illustrative and not in a limiting sense.

What is claimed is:

1. A cooling device for cooling a combustion engine, electrical components, and an electrical energy storage device of a hybrid vehicle, comprising:

a first circuit configured for cooling the combustion engine, a second circuit configured for cooling the electrical components, and a third circuit configured for cooling the electrical energy storage device, whereby a heat transfer fluid flows through the circuits which include a heat exchange device;

the heat exchange device having a heat exchanger divided into three members: a high temperature member HT connected to the first circuit, a low temperature member BT connected to the second circuit, and a very low temperature member TBT connected to the third circuit;

an upstream valve operatively connected between the first circuit and the third circuit upstream of the high temperature member HT of the heat exchanger and a downstream valve operatively connected between the first and third circuit downstream of the high temperature member HT of the heat exchanger; the downstream valve being a thermostatic valve which is actuated as a function of a temperature of the heat transfer fluid at the location of the cooling device, and the upstream valve being actuated as a function of a flow of the heat transfer fluid in the first circuit.

2. The cooling device according to claim 1, wherein the upstream valve comprises a double acting valve configured to close the first circuit and allow for the passage of the heat transfer fluid from the third circuit to the high temperature member HT of the heat exchanger when the flow of the heat transfer fluid in the first circuit is less than a predetermined flow.

3. The cooling device according to claim 1, wherein the downstream valve comprises a double acting thermostatic valve configured to close the first circuit and allow for the passage of the heat transfer fluid from the first circuit to the third circuit when the temperature of the heat transfer fluid at the location of the thermostatic valve is lower than the optimal operating temperature of the electrical energy storage device.

4. The cooling device according to claim 1, whereby the second circuit comprises a low temperature member BT, a pump, an inverter, an electrical machine and an automatic stop and start device of the combustion engine.

5. The cooling device according to claim 1, whereby the first and third circuits comprise a common degassing box.

6. The cooling device according to claim 1, whereby the electrical energy storage device comprises at least one battery.

7. The cooling device according to claim 1, whereby the electrical components comprise a pump, an inverter, an electrical machine and an automatic start and stop device for the combustion engine.

8. The cooling device according to claim 1, whereby each of the very low temperature, high temperature, and low temperature members TBT, HT and BT comprise an inlet box for heat transfer fluid, a radiator, and an outlet box for heat transfer fluid.

9. The cooling device according to claim 1, whereby the first circuit for cooling of the combustion engine comprises a water outlet valve, said water outlet valve being a thermostatic valve located at the outlet of the water outlet box and is configured for stopping the circulation of heat transfer fluid in the first circuit when the temperature of the heat transfer fluid in the water outlet box is lower than the optimal operating temperature of the combustion engine.

* * * * *